United States Patent [19]

Fischer

[11] 4,139,194

[45] Feb. 13, 1979

[54] RACKET FOR STRIKING A BALL

[75] Inventor: Josef Fischer, Ried im Innkreis, Austria

[73] Assignee: Fischer Gesellschaft m.b.H., Ried im Innkreis, Austria

[21] Appl. No.: 804,519

[22] Filed: Jun. 8, 1977

[30] Foreign Application Priority Data

Jun. 8, 1976 [AT] Austria ..... 4161/76

[51] Int. Cl.[2] ..... A63B 49/02

[52] U.S. Cl. ..... 273/73 C

[58] Field of Search ..... 273/73 R, 73 C, 73 D, 273/73 E, 73 F, 73 G, 73 H, 73 L

[56] References Cited

U.S. PATENT DOCUMENTS

| | | | |
|---|---|---|---|
| 1,558,507 | 10/1925 | Ryder | 273/73 E |
| 2,004,609 | 6/1935 | Johnston | 273/73 L |
| 4,032,142 | 6/1977 | Andrews | 273/73 R |

FOREIGN PATENT DOCUMENTS

| | | | |
|---|---|---|---|
| 358586 | 9/1922 | Fed. Rep. of Germany | 273/73 R |
| 1950258 | 4/1971 | Fed. Rep. of Germany | 273/73 C |
| 2106800 | 9/1971 | Fed. Rep. of Germany | 273/73 C |
| 2116920 | 10/1972 | Fed. Rep. of Germany | 273/73 D |
| 886136 | 6/1943 | France | 273/73 G |
| 2131677 | 11/1972 | France | 273/73 C |
| 2211857 | 7/1974 | France | 273/73 G |
| 204113 | 9/1923 | United Kingdom | 273/73 L |
| 431394 | 7/1935 | United Kingdom | 273/73 C |
| 712224 | 7/1954 | United Kingdom | 273/73 L |

*Primary Examiner*—Richard J. Apley

*Attorney, Agent, or Firm*—Fleit & Jacobson

[57] ABSTRACT

A closed hoop carries striking means and is connected to a bifurcated extension of a shaft and handle member by a plurality of vibration-absorbing elastic elements.

5 Claims, 4 Drawing Figures

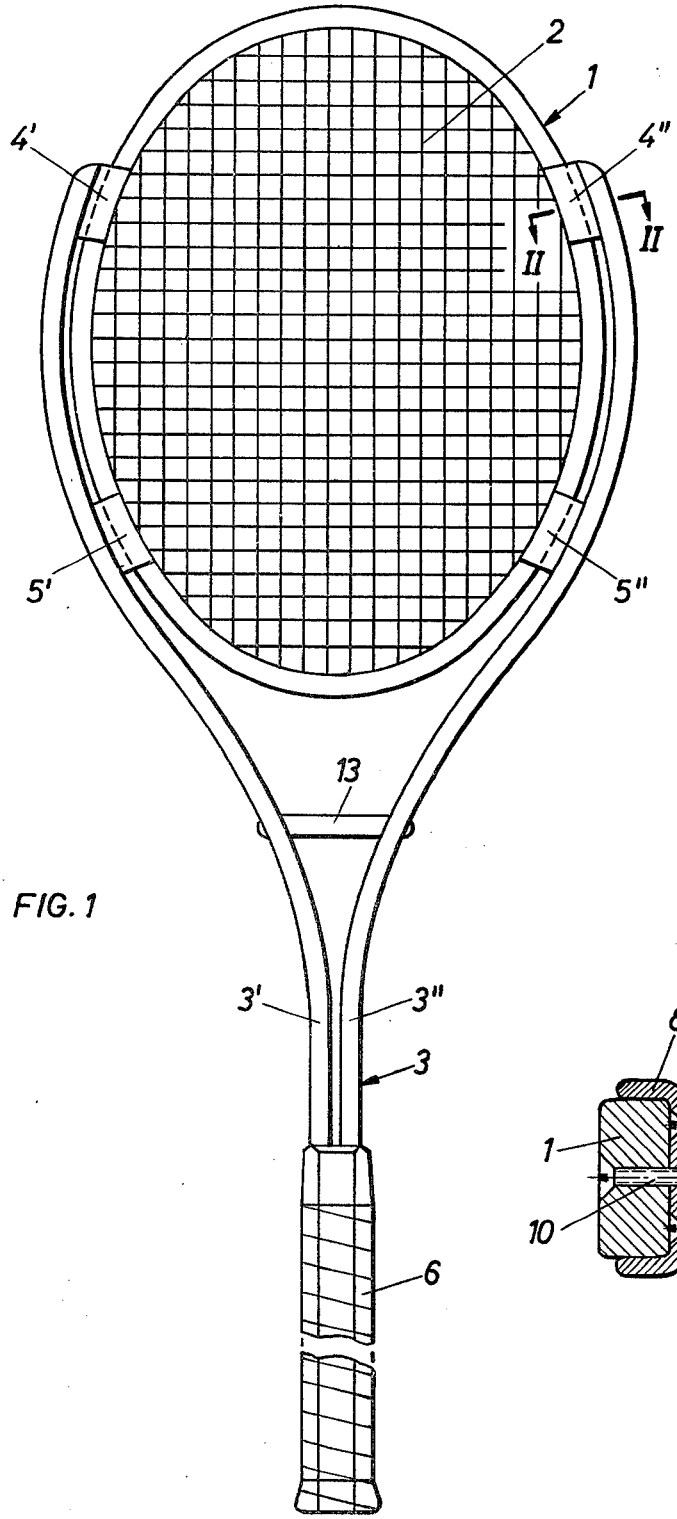
FIG. 1
FIG. 2
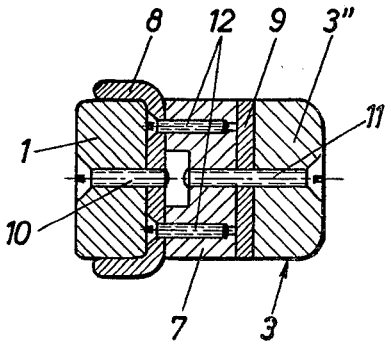

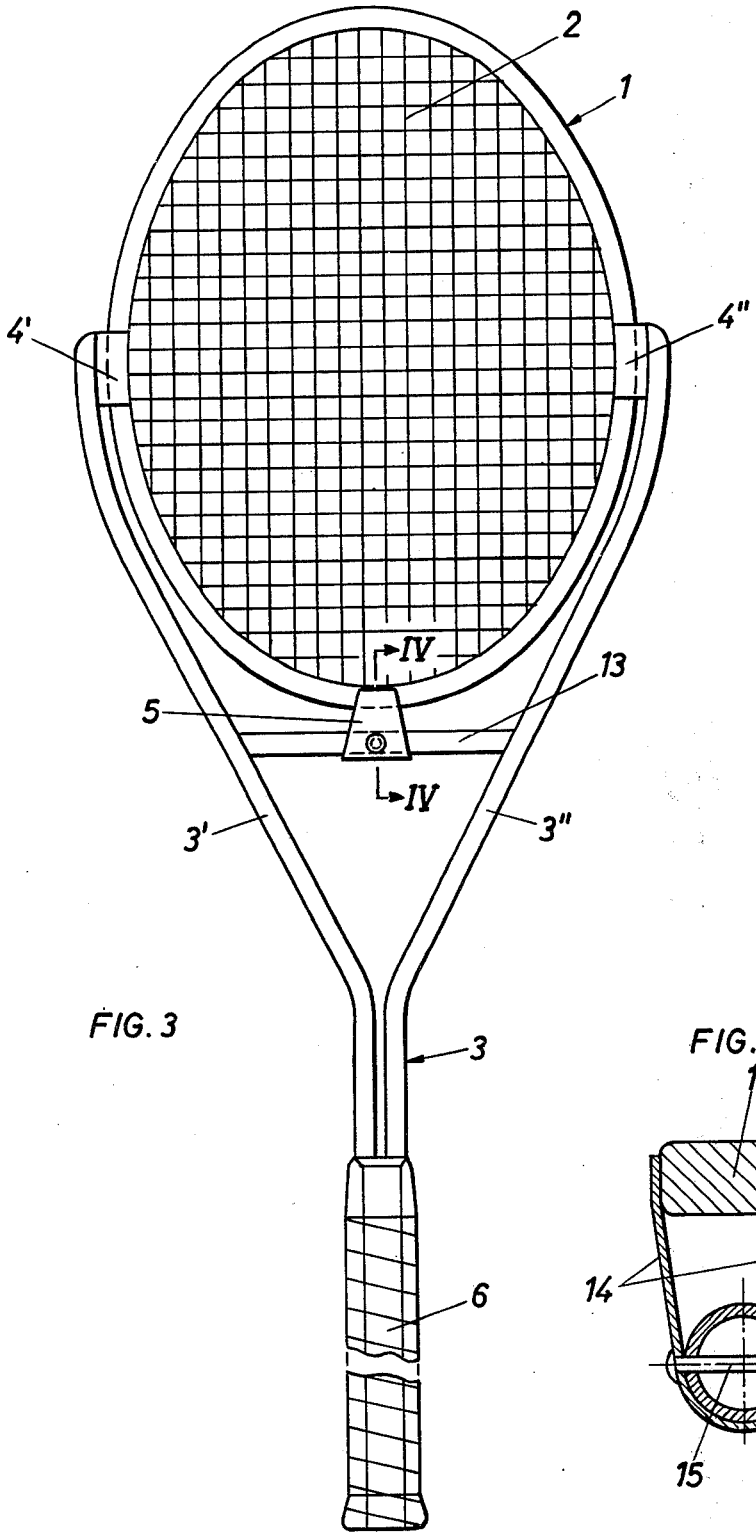
FIG. 3
FIG. 4
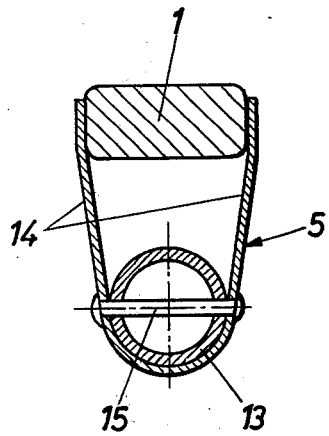

RACKET FOR STRIKING A BALL

SUMMARY OF THE INVENTION

Vibration excited in a hoop of an implement for striking a ball is absorbed by a plurality of elastic elements by which the hoop of the implement is connected to a bifurcated extension of a shaft.

This invention relates to an implement for striking a ball, particularly a tennis racket, in which a closed hoop serving to hold the stringing is detachably connected to a shaft and handle member, which has a bifurcated extension.

Tennis rackets consist usually of a shaft, which carries the handle and merges into a hoop, which holds the stringing. In the orthodox racket of wood, laminates of wood extend from the shaft around the hoop along the outside contour of the racket and the hoop is closed in the so-called heart region by inserts and glued shoulder-forming pieces. In metal rackets, the metal section rather than the laminates extends around the outside and the hoop is closed either by welded tubular members or by heart-shaped members of plastics material or metal, which are fixed by screws or rivets. In all known rackets of plastics material there is also a continuous transition from the shaft to the hoop without interposed buffer elements having a distinctly different stiffness. On the other hand, it has been proposed to provide a closed hoop, which is replaceable so that defective stringing can be replaced or different stringings can be used with the same shaft (Opened German Specification No. 1,925,518). But just as in the conventional rackets, the means proposed to connect such replaceable hoops to the shaft are intended to provide between the shaft and the hoop a connection which is as rigid and stiff as possible and does not permit of any movement of these parts relative to each other.

The momentum required to propel the ball is transmitted in part by the moving mass of the racket and in part as a bending moment, which acts through the shaft on the hand and arm. Because the ball as well as the stringing and the racket itself are elastically deformable, this momentum cannot be transmitted in the manner which is known from rigid bodies but is influenced by the resistance to elastic deformation as well as by the inertial resistance. The flexibiliby of the means which couple the several masses must not be neglected. The following significant deformations take place in the racket.

(1) The deformation which is caused by the momentum-producing force and has substantially the same direction as said force and depends on the inertial resistance of the racket and its resistance to deformation. The inertial resistance and the resistance to deformation may be described as "dynamic stiffness".

(2) Vibrations of partial systems at their natural frequencies. Such partial systems consist, e.g., of the ball coupled to the stringing, of the hoop, and of the shaft of the rackets. These vibrations may differ in phase from the stresses by which they have been initiated and may also be opposed in phase to such stresses.

The selection of those properties of the tennis racket which determine these deformations, namely, the mass and stiffness distribution with respect to the degrees of freedom of the stresses, will determine the rebounding of the ball and the subjective impressions of the player, e.g., with respect to the knock against the inside of the hand.

In the conventional tennis rackets in which the hoop is stiffly connected to the shaft, the different functions of the several parts are not properly taken into account. The hoop serves mainly to take up the stresses from the diaphragmlike stringing but must transmit only relatively small bending moments. On the other hand, the cross-sections of the shaft are spaced considerable distances apart from the point on which the ball impinges and for this reason must mainly transmit larger bending moments and the stiff connection to the hoop results in a strong twisting of those hoop cross-sections which are adjacent to the heart region. Specifically, this stiff connection cannot absorb the high-frequency vibration which is excited in the strings and hoop in response to hard blows and these vibrations are transmitted by the also stiff shaft almost without attenuation to the arm so that the joints, particularly the elbow joint, are overstrained.

To avoid these disadvantages of conventional tennis rackets, the invention proposes an implement of the kind described first hereinbefore, which serves to strike a ball and in which the hoop is connected to the shaft by a plurality of elastic buffers. This design affords the advantage that any vibration at higher frequency will be dynamically absorbed by these buffers. It has been found that this can be accomplished in a particularly favorable manner in that a closed hoop is suspended at a plurality of points from a bifurcated extension of the shaft by interposed sandwich-type rubber-metal connectors. The frequency band which can be absorbed can be selected by the matching of the spring constants of these sandwich-type connectors and the vibratable masses and stiffness characteristics of the remaining parts of the system. Another advantage afforded by the design according to the invention resides in that the striking surface provided by the stringing as well as the buffers can be replaced for adaptation to specific requirements.

Further details of the invention will be explained more fully with reference to the following drawings, which show two illustrative embodiments of a tennis racket embodying the invention.

FIG. 1 is a top plan view showing a first embodiment of the tennis racket,

FIG. 2 is a sectional view taken on line II—II in FIG. 1,

FIG. 3 is a top plan view showing a second embodiment of the tennis racket, and

FIG. 4 is a sectional view taken on line IV—IV in FIG. 3.

In both embodiments, the racket comprises an oval hoop 1, which carries stringing 2, and a shaft 3, which consists of two shaft rods 3', 3'', which are connected at one end to a handle 6 and at the other end are bifurcated and extend around part of the periphery of the hoop so that the outer end of the latter is exposed.

In the embodiment shown in FIG. 1, the shaft rods 3', 3'' extend around the hoop 3 beyond its transverse center line and each shaft rod is connected to the hoop by two vibration-absorbing elements 4', 5' and 4'', 5'', respectively, which are substantially symmetrically disposed with respect to the transverse center line of the frame 1. These elements may be designed as desired, provided that they can transform a vibration of the frame 1 into an elastic deformation of part of the element. In the present case these elements consist of sandwich-type connectors and as shown in FIG. 2 comprise a rubber block 7, which is clamped between carrying plates 8, 9, one of which (8) is secured by a screw 10 to the hoop 1 whereas the other (9) is secured by a screw 11 to the shaft 3, specifically to its rod 3", as is apparent from the sectional view. The screw 11 extends also through the rubber block 7 to connect the same to the carrying plate 9. The carrying plate 8 is U-shaped or bifurcated and embraces the hoop 1 and is connected to the rubber block 7 by two screws 12, which extend from the carrying plate 8 and terminate in the rubber block 7 so that the latter can follow a relative movement of the two plates 8, 9 and can compensate such movement. Owing to this arrangement, a vibration of the hoop 1 will cause a deformation of the rubber block 7 but will not be transmitted to any substantial degree to the shaft 3. To prestress the shaft rods 3', 3", the same are fixedly connected to each other by a transverse web 13 in the bifurcated or neck portion of the shaft 3.

The tennis racket shown in FIG. 3 differs from the one shown in FIG. 1 mainly in that three rather than four vibration-absorbing elements are provided. Two of such elements, designated 4', 4", connect the ends of the shaft rods 3', 3" to the hoop 1 at its transverse center line and are designed as shown in FIG. 2. The third element engages the hoop 1 at its longitudinal center line at the end which is near the shaft and as shown in FIG. 4 consists of two lugs 14 of preferably metallic resilient material and is secured to the transverse web, e.g., by a rivet 15. These lugs embrace the end portion of the hoop like jaws and may form parts of a U-shaped member which embraces the web 13.

It will be understood that the design and arrangement of the connecting elements may be modified within the scope of the invention. Besides, the shaft 3 may entirely enclose the hoop, provided that the parts are connected only at discrete points by the elements suggested by the invention.

What is claimed is:

1. A racket adapted to carry means for striking a ball and comprising:

a closed hoop adapted to carry the means for striking a ball;

a shaft and handle member having a handle portion and a bifurcated extension; and a plurality of elastic connecting links for connecting said bifurcated extension to sides of said closed hoop, said elastic connecting links being formed as vibration absorbing buffer elements and being positioned so that at least one of said elastic connecting links is situated on each side of said closed hoop, each of said elastic connecting links comprising:

a block formed of resilient material deformable by vibration of said closed loop, and two supporting plates positioned on opposite sides of said block with at least one of said supporting plates secured to said block, a first of said supporting plates being secured to said closed hoop and a second of said supporting plates being secured to said bifurcated extension.

2. A racket as set forth in claim 1 characterized in that the bifurcated extension of said shaft and handle member terminates in two shaft rods, which extend only around part of said closed hoop, each of said shaft rods being connected to said closed hoop by at least one of said elastic connecting links.

3. A racket as set forth in claim 2 characterized in that said closed hoop has a transverse center line and in that each of said shaft rods is connected with said closed hoop by two of said elastic connecting links, said elastic connecting links being symmetrically disposed with respect to the transverse center line of said closed hoop.

4. A racket as set forth in claim 1 characterized in that said closed loop and said bifurcated extension are detachably connected by said elastic connecting links.

5. A racket as set forth in claim 2 characterized in that said closed hoop has a transverse and a longitudinal center line, and in that each shaft rod is connected to the closed hoop by one of said elastic connecting links positioned in the vicinity of the transverse center line, the tennis racket further comprising a transverse web connecting the shaft rods to each other at the end of the closed hoop closest to the handle portion of the handle and shaft member, and two lugs of spring-elastic material attached to the transverse web and engageable with sides of the closed hoop in the vicinity of the longitudinal center line.

* * * * *